United States Patent [19]

Merrick

[11] Patent Number: 5,005,458

[45] **Date of Patent: * Apr. 9, 1991**

[54] LOW COST PUNCH MECHANISM

[75] Inventor: Robert G. Merrick, Cupertino, Calif.

[73] Assignee: Merrick Industries, Incorporated, Sunnyvale, Calif.

[ * ] Notice: The portion of the term of this patent subsequent to Sep. 26, 2006 has been disclaimed.

[21] Appl. No.: 411,143

[22] Filed: Sep. 22, 1989

Related U.S. Application Data

[63] Continuation-in-part of Ser. No. 225,638, Jul. 27, 1988, Pat. No. 4,869,143, which is a continuation of Ser. No. 743,559, Jun. 11, 1985, abandoned, which is a continuation-in-part of Ser. No. 623,799, Jun. 22, 1984, abandoned.

[51] Int. Cl.[5] ..... B26D 1/12

[52] U.S. Cl. ..... 83/599; 83/689; 83/698; 16/243; 16/260; 16/266

[58] Field of Search ..... 83/467.1, 599, 685–688, 83/691, 689, 698; 16/260, 243, 265, 266, 312

[56] References Cited

U.S. PATENT DOCUMENTS 4,869,143 9/1989 Merrick et al. ..... 83/599

*Primary Examiner*—Frank T. Yost
*Assistant Examiner*—Scott A. Smith
*Attorney, Agent, or Firm*—Skjerven, Morrill, MacPherson, Franklin & Friel

[57] ABSTRACT

A pocket size inexpensive punch mechanism is provided to punch openings in paper objects, the punching teeth having a configuration especially adapted to produce sharp initial penetration of the paper object, followed by smoother cutting of the remainder of the opening.

3 Claims, 1 Drawing Sheet

LOW COST PUNCH MECHANISM

CROSS-REFERENCE TO RELATED APPLICATIONS

This application-in-part of co-pending application Ser. No. 07/225,638, filed July 27, 1988, now U.S. Pat. No. 4,869,143 which in turn is a continuation of co-pending application Ser. No. 07/743,559, filed June 11, 1985, which in turn is a continuation-in-part of co-pending application Ser. No. 06/623,799, filed June 22, 1984, both now abandoned. Application Ser. No. 07/168,304 filed March 15, 1988, now abandoned, was a continuation-in-part of Ser. No. 07/743,559 identified above.

BACKGROUND OF THE INVENTION

1. Field of the Invention

This invention relates to mechanism for punching holes in paper objects utilizing a reliable, low cost punch device. The above identified co-pending application Ser. No. 07/225,638 discloses and claims a punch mechanism which is particularly adapted to punching openings in the edges of business cards so as to facilitate the mounting of a variety of such card-like objects, including business cards, in card files.

2. Description of the Prior Art

Punches for punching paper and plastic articles have been known for some time. Most of such punches have been constructed of metal, or at least involved metal punching parts, thereby increasing their weight and cost.

SUMMARY OF THE INVENTION

The present invention provides a punch mechanism, preferably made entirely of plastic, which can be manufactured by molding and which is capable of punching one thickness of paper at a time and provides a significant number of operations before the plastic punching teeth lose their effective cutting edge. The device is capable of producing openings of a variety of shapes, depending on the configuration of the punching teeth.

DESCRIPTION OF THE PREFERRED EMBODIMENT

The punching or slotting tool of the present invention is a relatively inexpensive pocket size device, preferably made of a hard plastic material, which is designed to cut the appropriate dual openings in at least a selected number of sheets of paper (for example, 5,000 or more sheets), one at a time, without showing appreciable wear. In addition to being low cost and portable, it permits the user to look through the die holes to see what information, if any, is subject to being cut away prior to cutting. This feature gives the user the option of adjusting away from needed information and/or to transcribe such data elsewhere on the sheet prior to punching.

Figure 1:
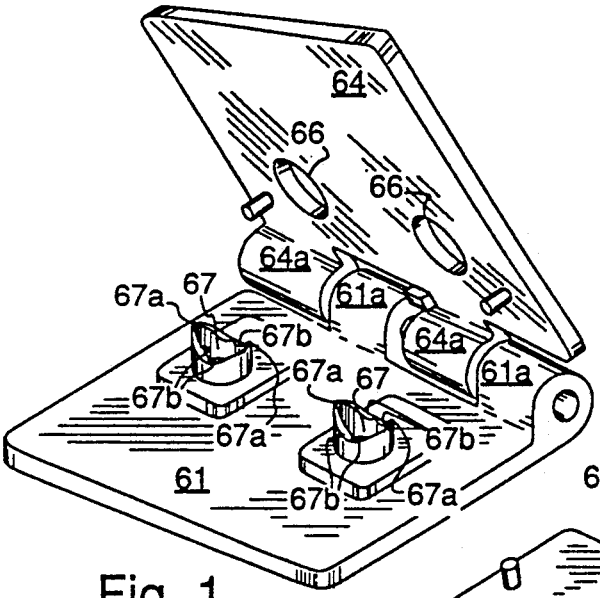
FIG. 1 is a perspective view of one embodiment of the present invention.

Referring to the perspective view of FIG. 1, the punching tool includes a hinged punch plate member 61 having cutting or punching teeth 67 which engage round openings 66 in a complementary die plate member 64.

Each of punching teeth 67 has two diametrically opposite sharp peak-like toothed portions 67*a* in approximately the middle thereof to facilitate penetration of the paper object upon contact therewith. On either side of portions 67*a* and contiguous therewith, the punching teeth have a wider cutting edge portion 67*b*, this widened portion providing increased cutting surface to increase the wear life of the punching teeth while still accomplishing cutting after the initial penetration by portions 67*a*.

Figure 2:
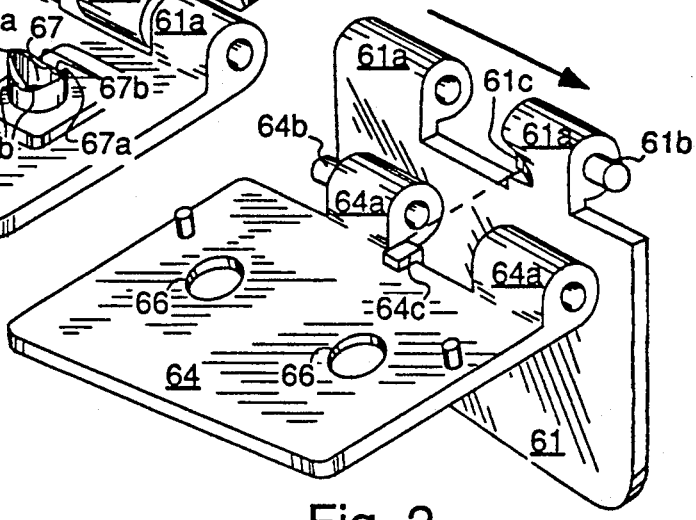
FIG. 2 is an exploded perspective view of the device in FIG. 1 showing the two punch members in their most separated position to illustrate the portion of the structure which insures locking together of the members.

Members 61 and 64 are preferably molded of a suitable plastic material As best seen in FIG. 2, parts 61 and 64 are preferably formed in a hinged configuration with cylindrical portions 61*a* and 64*a*, each of these portions having an extending pin portion 61*b* and 64*b* which is adapted to engage a mating opening in the corresponding cylindrical portions of 64*a* and 61*a* of the other member for assembly of the punch mechanism without requiring the use of a separate pin component for hinging. Thus, the present invention provides a novel hinged mechanism which, independently of the function performed by members 61, 64, can be fabricated using only the two components 61, 64.

Figure 3:
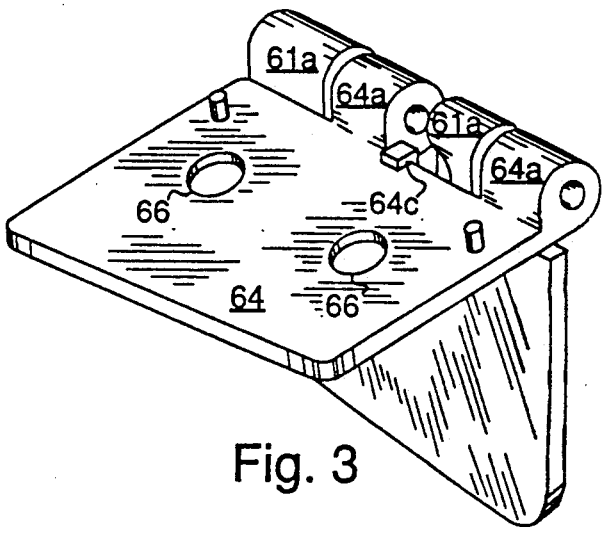
FIG. 3 is a perspective view showing how the punch members engage each other to lock together.

In accordance with an important feature of the invention, the punch member is constructed in a manner which insures a stable mechanical relationship between the two parts of the punch. As shown in FIG. 2, member 64 is provided with a raised lug member 64*c* at the rear thereof adjacent one of the cylindrical portions 64*a*. Lug 64*c* is adapted to engage a cam slot or grooved portion 61*c* in the one cylindrical portion 61*a* of member 61. This engagement occurs only when members 61 and 64 are in the relative position shown in FIG. 2; that is, when the members 61, 64 are disposed at right angles to each other for assembly of the two members While maintaining this perpendicular relationship, members 61, 64 may be moved toward each other, with pins 61*b*, 64*b* passing through or clearing the spaces between cylindrical portions 61*a*, 64*a*. When pins 61*b*, 64*b* are axially aligned with the corresponding openings in cylindrical portions 64*a*, 61*a*, lug 64*c* will be disposed in slot portion 61*c*. Then, by providing relative lateral movement between members 61, 64 (moving member 64 to the left in the drawing or moving member 61 to the right), pins 61*b*, 64*b* will enter the corresponding openings in cylindrical portions 64*a*, 61*a* while lug 64*c* slides laterally in slot 61*c* as shown in FIG. 3. The engagement between pins 61*b*, 64*b* and the openings in portions 64*a*, 61*a* is preferably of a semipress fit type to insure firm snap-on locking engagement of members 61, 64 while still permitting disassembly of the mechanism if required.

After assembly, members 61, 64 are rotated toward each other on the axis formed by pins 61*b*, 64*b* and cylindrical portions 64*a*, 61*a*. When members 61, 64 are rotated slightly from the position shown in FIG. 3, lug 64*c* leaves slot 61*c* and bears against or is positioned closely adjacent to the left edge of the cylindrical portion 61*a*. This relationship between lug 67*c* and portion 61*a* prevents any lateral movement between members 61, 64, to thereby prevent inadvertent disassembly of the punch mechanism. To disassemble the punch, members 61, 64 are returned to the position shown in FIG. 3, and relative movement between members 61, 64 is provided in the direction opposite to that employed for assembly With this movement, lug 67*c* slides laterally in groove 61*c* and pins 61*b*, 64*b* can be withdrawn from cylindrical portions 64*a*, 61*a*, against the snap-on lock fit described above for assembly, permitting separation of members 61, 64.

Figure 4:
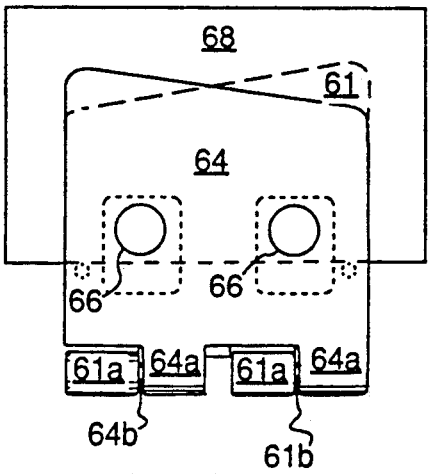
FIG. 4 is a plan view illustrating the placement of a card member in the punch after completion of punching.

The punching operation is illustrated in FIG. 4 where an object 68, such as a piece of paper, is shown inserted in the punch between members 61, 64.

The extreme edges of the punch and die plates of the tool are biased oppositely, as seen in FIG. 4, to provide thumb and finger tabs useful in opening the hinge-like device should it jam closed.

Figure 5C:
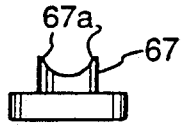
FIG. 5*a*, 5*b* and 5*c* show three views of a punching teeth for punching circular openings in a paper object in accordance with this invention.
Figure 5B:
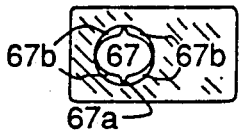
Figure 5A:
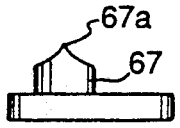

FIGS. 5*a*, 5*b*, and 5*c* illustrate details of an embodiment of the punching teeth to punch round openings in paper pieces or objects As shown in the side view of the teeth in FIG. 5*a* and the front view of the teeth in FIG. 5*c*, the teeth 67 have the two sharp peak-like toothed portions 67*a* diametrically opposite each other to perform the initial penetration of the object to be punched. As best shown in FIG. 5*b*, teeth 67 also have wider cutting portions 67*b*, similar to those shown in FIG. 1 to provide increased cutting surfaces to improve the wear life of the teeth.

Although the embodiment in FIG. 5 showed a punch mechanism for punching circular openings, it will be apparent that other configurations are possible by proper selection of the configuration of the punching teeth.

I claim:

1. A punch mechanism for providing openings in a paper object;

said punch mechanism having a punch plate member movably hinged to a die plate member;

said punch plate member carrying a pair of spaced punching teeth adapted to engage openings in said die plate member when said punch plate member is moved closely adjacent said die plate member;

each of said punching teeth having a maximum of two sharp peak-like portions or crests diametrically opposite to each other for producing initial penetration of said paper object;

each of said punching teeth having rounded wider cutting portions or roots contiguous with said peak-like portions to produce further and sequential cutting of said paper object after said initial penetration by said peaklike portions, while providing additional wear surfaces for said teeth;

said punch plate member being hinged along an axis extending through at lest two cylinders in said punch plate member and a plurality of cylinders in said die plate member;

a cam slot in one of said cylinders of either said punch plate member or said die plate member;

said cam slot having a shoulder therein;

a lug on the other of said members, said lug being positioned to engage and disengage said cam slot only when said members are a. in a predetermined physical relationship to each other, and b. when manual force is applied along the direction of the hinge axis to snap said lug over said shoulder of said cam slot, thereby resulting in a structure having a semipress fit assembly; whereby said lug in cooperation with said cam slot guides said members into a coarse alignment and prevents disassembly of said members when said members are in other than said predetermined physical relationship;

thereby resulting in a structure which can be assembled and disassembled using only manual force, yet which, because of said semipress fit assembly, is not subject to inadvertent disassembly even when said members are in said predetermined physical relationship.

2. A mechanism is accordance with claim 1, including punch plate and die plate members having edges which are oppositely offset from each other to provide thumb and finger tabs to facilitate the movement apart of said members.

3. A mechanism in accordance with claim 1 in which one of said cylinders in each of said members is provided with an axially extending pin along said axis, each of said pins being adapted to be moved axially, when said members are in said predetermined physical relationship, to engage an opening in one of said cylinders of the other of said members to thereby provide hinged movement between said members.

* * * * *